US007159827B2

(12) United States Patent
Bombelli

(10) Patent No.: US 7,159,827 B2
(45) Date of Patent: Jan. 9, 2007

(54) ARM SUPPORT WITH MOUSE PAD

(76) Inventor: Andrea Bombelli, #1-1949 Beach Avenue, Vancouver, British Columbia (CA) V6G 1Z2

( * ) Notice: Subject to any disclaimer, the term of this patent is extended or adjusted under 35 U.S.C. 154(b) by 176 days.

(21) Appl. No.: 10/709,682

(22) Filed: May 22, 2004

(65) Prior Publication Data

US 2005/0011998 A1 Jan. 20, 2005

Related U.S. Application Data

(60) Provisional application No. 60/472,646, filed on May 22, 2003.

(51) Int. Cl.
*B43L 15/00* (2006.01)

(52) U.S. Cl. ..... 248/118.1; 248/918

(58) Field of Classification Search ..... 248/118.1, 248/118, 346.01, 918, 282.1, 289.11; 400/715; 345/156

See application file for complete search history.

(56) References Cited

U.S. PATENT DOCUMENTS

| | | | | |
|---|---|---|---|---|
| 5,074,501 | A | 12/1991 | Holtta | |
| 5,402,972 | A * | 4/1995 | Schmidt | 248/118 |
| 5,405,109 | A | 4/1995 | Nordnes | |
| 5,975,469 | A | 11/1999 | Chen | |
| 6,109,571 | A | 8/2000 | Hirschovits et al. | |
| 6,347,771 | B1 | 2/2002 | Lauzon et al. | |
| 2005/0184204 | A1 * | 8/2005 | Lopez-Apodaca | 248/118.1 |

* cited by examiner

*Primary Examiner*—Ramon O Ramirez

(57) ABSTRACT

An arm support with mouse pad including a clamp for mounting to a workstation desk, connected rotationally to a support structure. The support structure including three rotationally interconnected shafts, a mouse pad connected to the first shaft and a forearm rest connected to the third shaft. The clamp specifically designed such that the support structure can be rotated 360 degrees around a vertical axis from a using position extending from the front edge of the desk at various angles, to a storage position under the lower surface of the desk without disconnecting from the clamp.

6 Claims, 5 Drawing Sheets

18
42

19
20
34
14

41
20
18

10
41
23
24
40
25
27
26
39
22
3
9
11
38
12
13

10
25
23
24
21
27
26
22
9
11
3
12
13

ARM SUPPORT WITH MOUSE PAD

CROSS REFERENCE TO RELATED APPLICATIONS

This application claims priority to U.S. Provisional Application No. 60/472,646, filed on May 22, 2003, and entitled "ARM SUPPORT WITH MOUSE PAD," the entirety of which is incorporated herein by reference.

BACKGROUND OF INVENTION

The computer has become a popular tool for work, education, and entertainment. Widespread frequent and continuous use of computers, and in particular of the computer mouse and keyboard, can cause discomfort and sometimes injury due to repetitive motion and poor user posture. While a number of products have been invented and developed to improve the ergonomics of computer use and reduce the risk of discomfort and injury after long term use, existing products do not address some key requirements for widespread adoption of arm and mouse supports.

First, existing products and inventions are difficult to attach to the computer desk. Second, existing products and inventions are cumbersome to the user because they cannot be stored under the work surface of the desk while still attached to the desk when not in use. Third, existing products and inventions either do not support the mouse itself, requiring the mouse to be placed on the desk surface, or they directly align the mouse pad with the forearm support, making it impossible for users to comfortably alternate between operation of the keyboard, mouse, and other devices. Therefore, there exists a need for a device that addresses these disadvantages.

SUMMARY OF INVENTION

In one preferred embodiment, among others, a storable forearm support and mouse pad generally addresses the ergonomics of computer use and provides improvements in the comfort, safety and productivity of computer users. Specifically, the present invention, as one preferred embodiment, among others, is a storable forearm support and mouse pad, which attaches easily to the workstation desk, is designed to be easily stored under the desk while still attached to the desk when not in use, and is adjustable for the operation of the mouse, keyboard or other hand-operated devices, or for the operation of a combination of the aforementioned devices simultaneously, and for transitioning between the operation of any combination of such devices.

Additionally, the present invention, as one preferred embodiment, easily attaches to the surface of the computer workstation or desk, easily stores under the desk while still attached to the desk when not in use, and improves the productivity of the computer user by providing a more comfortable and safer means of operating the mouse and other devices while working at a computer workstation. One aspect of the device in accordance with the present invention includes a clamping mechanism that enables easy attachment to the computer workstation without damaging the surface of the workstation desk. The design and functionality also allows it to be easily stored away under the surface of the workstation desk while still attached to the desk making it unobtrusive when the workstation desk is being used for other purposes. The device is designed to offer a higher degree of ergonomic flexibility to computer users. More specifically, users choose both the most comfortable seating position and the most comfortable arm, wrist and hand positions for effective operation of the mouse, keyboard and other hand-operated devices. The device allows the user to comfortably lean back in the chair while surfing the Internet or performing other more relaxed activities at the computer. Additionally, the device also allows the user to lean forward while typing or performing more intensive work with the mouse or other devices on or adjacent to the desk such as a computer keyboard. Because the mouse support is rotationally connected to the forearm support, the device allows the user to comfortably position the forearm rest and mouse pad for simultaneous use of the mouse and keyboard and other hand-operated devices, while minimizing strain to the wrist, neck and shoulders, thereby reducing fatigue and the risk of potential injury associated with long term use and repetitive motion. In addition, the device allows the user to easily transition to activities which require closer proximity to the desk (such as typing) without removing the forearm from the forearm rest, thereby retaining the advantages of the forearm rest during these activities. Therefore, the device offers the user consistent support while comfortably operating a mouse, a keyboard, other hand-operated devices, or a combination of the aforementioned devices simultaneously, and for transitioning between the operation of any combination of such devices.

The present invention in a further preferred embodiment, among others, includes a storable forearm support and mouse pad device to be attached to a workstation desk next to a computer keyboard. The device supports the forearm of the computer user as well as the computer mouse and comprises a support clamp, a support structure comprising three sturdy arms, a mouse pad, and a forearm rest. The support clamp is specifically designed to enable the user to easily attach and secure the storable forearm support and mouse pad to the workstation desk and to support the weight of the mouse, and the user's forearm, wrist, and hand. The mouse pad is directly attached to the top side of the first support arm, or the mouse pad support arm, which is rotationally connected at one end to the support clamp and at the opposite end to the second support arm, or the central support arm. The connection between the mouse pad support arm and the support clamp is designed to allow full 360 degree rotation around the first swivel joint, or the support clamp swivel joint, with enough clearance from the lower surface of the workstation desk to enable the entire storable forearm support and mouse pad assembly to be stored neatly under the workstation desk while still attached to the desk when it is not in use. The connection between the mouse pad support arm and the central support arm is designed to allow approximately 180 degrees of rotation around the second swivel joint, or the central swivel joint, to enable the flexible lateral positioning of the forearm rest with respect to the mouse pad for the optimal comfort of the user. The opposite end of the central support arm is rotationally interconnected to the third support arm, or the forearm support arm. The connection between the central support arm and the forearm support arm is designed to allow full 360 degree rotation around the third swivel joint, or the forearm swivel joint, with enough clearance from the top surface of the central support arm and the mouse pad to allow the forearm rest to rotate a full 360 degrees allowing the user to adjust the forearm rest to any angle for optimal comfort in using either the keyboard, or the mouse, or any other hand-operated device, or any combination of devices. The forearm rest is attached directly to the top surface of the forearm support arm. The top surface of the mouse pad may be made of a textured material to enable the use of a typical computer mouse. The top surface of the forearm rest may be made of a soft or padded material to provide comfort to the user's forearm during operation. The storable forearm support and mouse pad allows the user to operate the mouse, keyboard, other hand-held devices, or a combination of the aforementioned devices simultaneously, and for transitioning between the operation of any combination of such devices, either while leaning back in the chair for more relaxed workstation activities or while leaning forward in the chair for more intensive workstation activities.

By using the present invention, the user will enjoy improved comfort and safety, and improved productivity as a result of reduced eye strain caused by proximity to the computer monitor, and reduced fatigue caused by poor posture. The device offers the user consistent support while comfortably operating a mouse, a keyboard, other hand-operated devices, or a combination of the aforementioned devices simultaneously, and for transitioning between the operation of any combination of such devices. The device is specifically designed with a clamping mechanism that makes it very easy to install and to adjust to different workstation desks. When not in use, the device neatly stores under the workstation desk while still attached to the desk allowing the operator to perform other tasks at and in proximity to the workstation desk without obstruction.

The device improves the productivity of the computer user by providing a more comfortable and safer means of working at a computer workstation. More specifically, the device provides a storable forearm support and mouse pad which (1) allows the user to comfortably operate the mouse of the computer at a comfortable position and a safe distance from the computer monitor, (2) may be easily and safely secured to a workstation desk next to a computer, (3) is adjustable for the operation of the mouse, keyboard or other hand-operated devices, or for the operation of a combination of the aforementioned devices simultaneously, and for transitioning between the operation of any combination of such devices, (4) neatly stores under the surface of the workstation desk while still attached to the desk when not in use so as to be completely unburdening to the user when performing other activities which do not require the invention at or in proximity to the workstation desk, and (5) may include a cushioning element for the storable forearm support for the increased comfort of the user, and a textured surface for the mouse pad to permit the use of a standard computer mouse.

The above is a general description that describes certain features of the present invention such that the reader may better understand the following, more detailed description. However, it is understood that the following detailed description will describe additional features which will contribute to the overall value of the device, and that the terms, wording and phrasing used in both the above general description and the following detailed description should not be considered limiting. It is further understood that the following is a detailed description of a preferred embodiment referred to as Mouse-at-Ease, however, the scope of the present invention is not limited to any specific embodiment, and as such, not limited in its construction, in its arrangement of components, in its dimensions, or in its material makeup.

BRIEF DESCRIPTION OF DRAWINGS

The following figures are provided:

FIG. 3(*b*) is a top view of FIG. 3(*a*) The figure also includes the optional basket and the mouse (shown resting in the optional basket).

FIG. 4(*b*) is a side partial cut-away perspective view of the arm support with pad of FIG. 1 shown in its fully extended operating position. The figure includes a partial view of the optional mouse basket.

FIG. 5(*b*) is an exploded view of FIG. 5(*a*).

DETAILED DESCRIPTION

Figure 1:
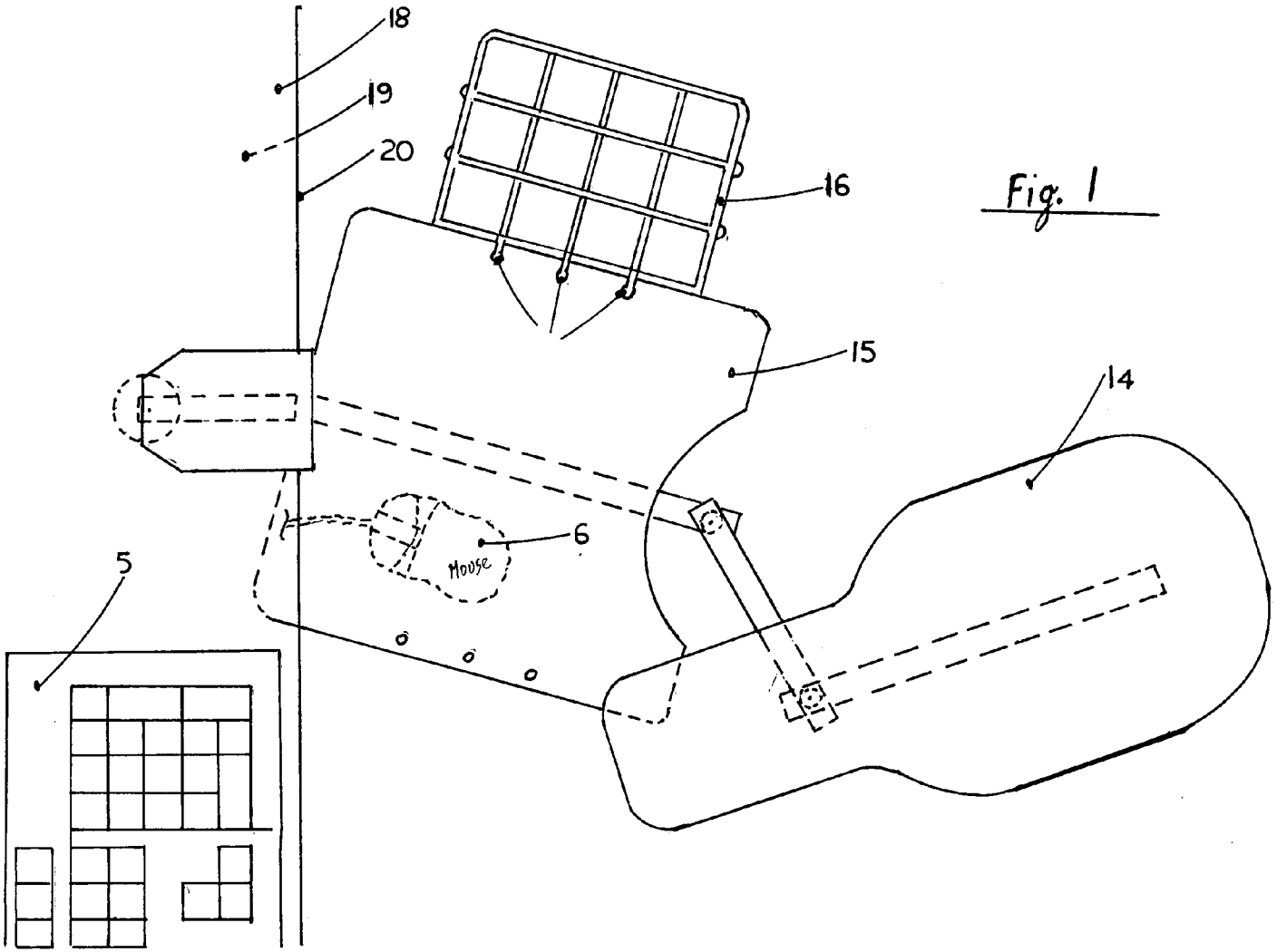
FIG. 1 is a top view of the arm support with pad, in accordance with one preferred embodiment, shown in an operating position with the forearm rest partially extended. The figure includes an optional mouse basket, a mouse (shown resting on the mouse pad), a possible placement of a keyboard, and a workstation desk surface.

The present invention preferably comprises three major components [FIG. 1,4(*b*),2], a support clamp 34 comprised of elements 1, 3, 7–9, and 28–33, a pad 15, and a forearm rest 14, that are interconnected by a supporting structure. An optional basket 16, attached to the pad 15, is available for storage of for example, a mouse when it is not being used.

Figure 2:
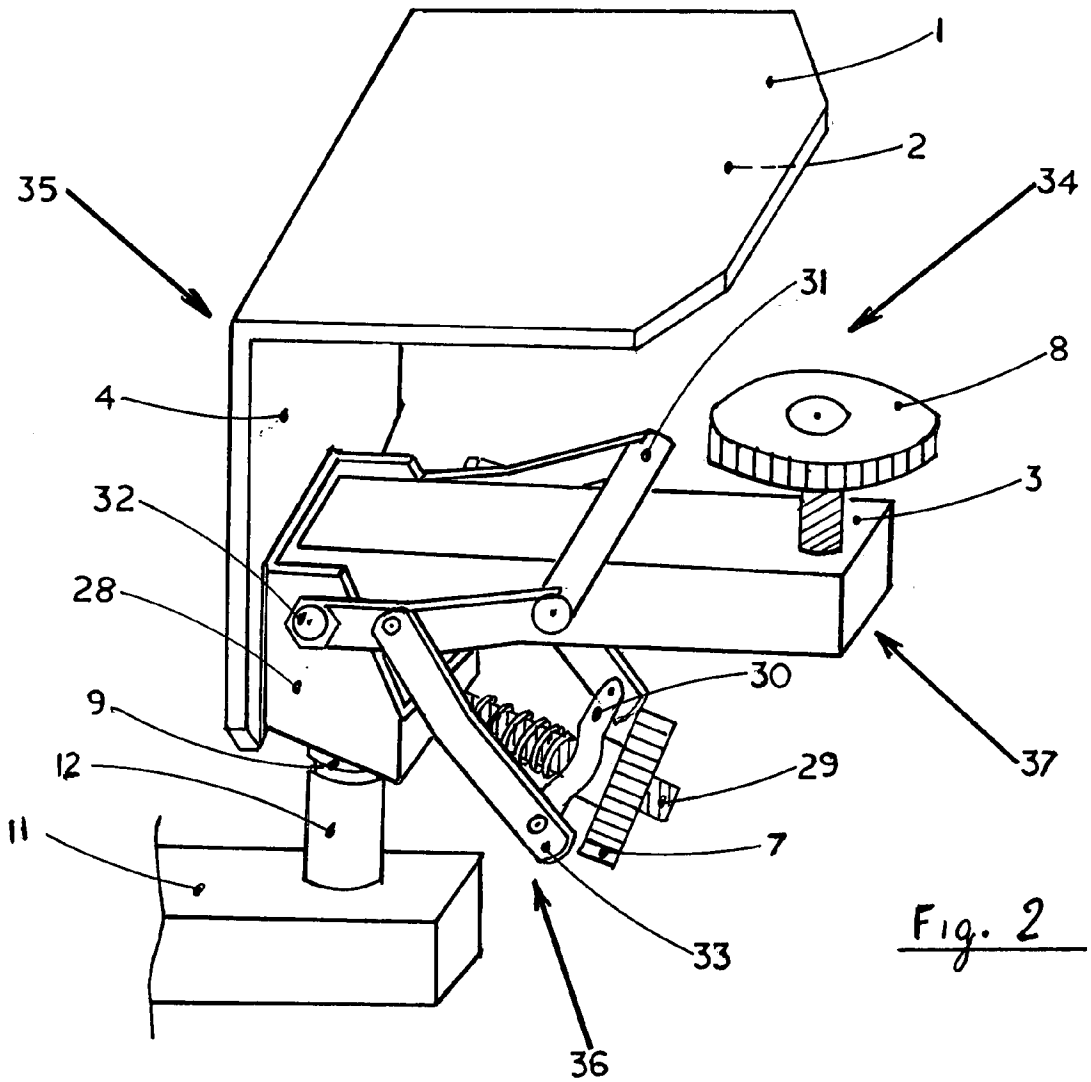
FIG. 2 is a perspective view of the support clamp portion of the arm support with pad of FIG. 1. The figure includes the main structure of the support clamp, the sturdy adjustment arm, the adjustment bolt and the post that connects the support clamp to the mouse pad support arm. The figure also includes a partial view of the mouse pad support arm.
Figure 3:
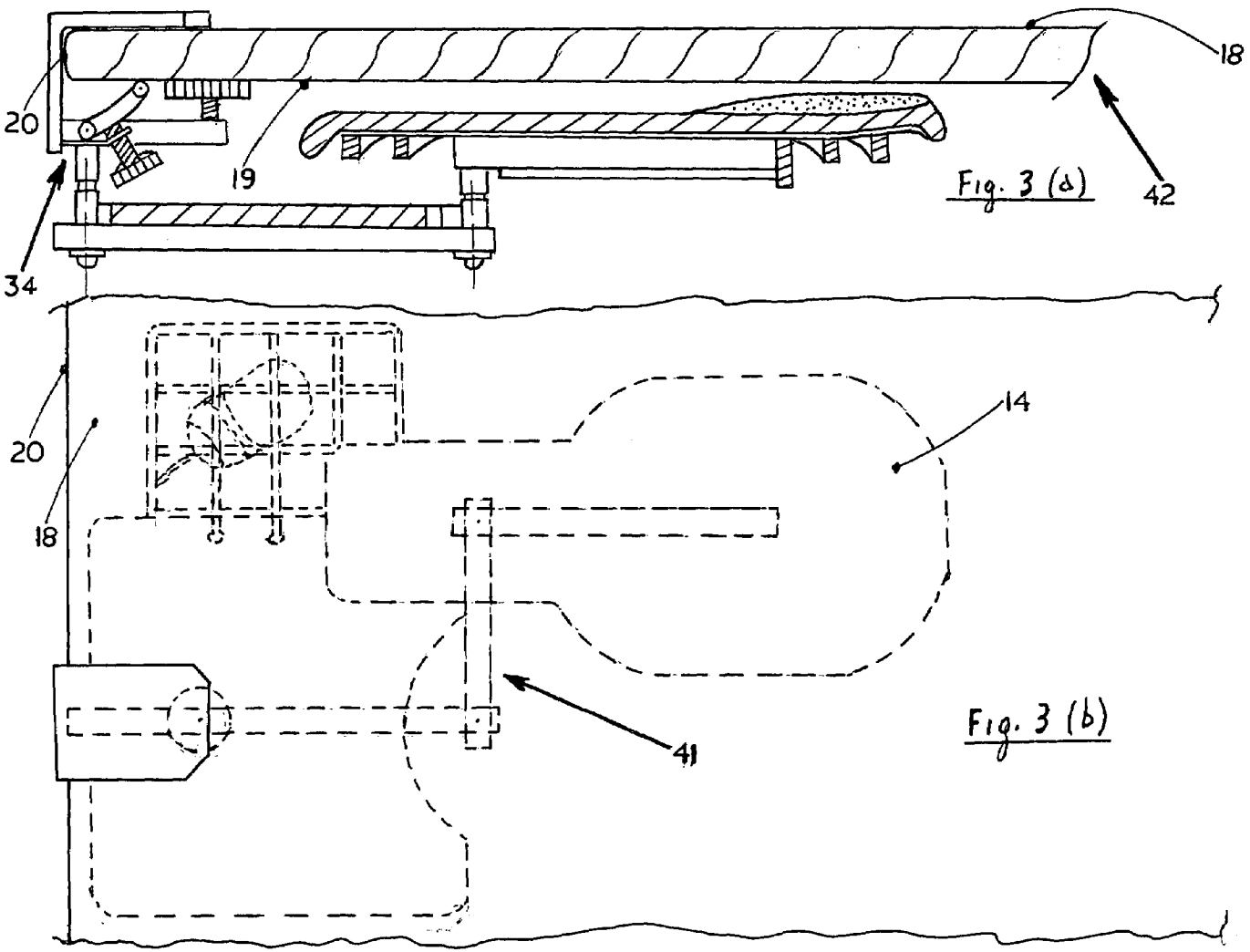
FIG. 3(*a*) is a side cross-sectional view of the arm support with pad of FIG. 1 in a less extended stored position under the workstation desk. The figure includes the workstation desk.

The support clamp 34 [FIG. 2,4(*a*)] may comprise a main clamp element 35 composesed of elements 1, 28, and 29 that positions the clamp at the top surface 18 and front edge 20 of a workstation desk 42 and supports the other elements of the support clamp 34, which comprises a sturdy adjustment arm 3 that is connected to a main clamp element 35 by a pivoting arm 36 comprising elements 31–33, a screw nut 7 that fastens the pivoting arm against a lower surface 19 of a workstation desk 42, an adjustment bolt 8 that adjusts the gap between the top surface of the adjustment bolt 8 and a bottom surface 2 of the main clamp element 35 to match the thickness of the workstation desk 42, and an alignment post 9 that connects the support clamp 34 to a corresponding rotating cylinder 12 on a pad support arm 11.

Figure 4:
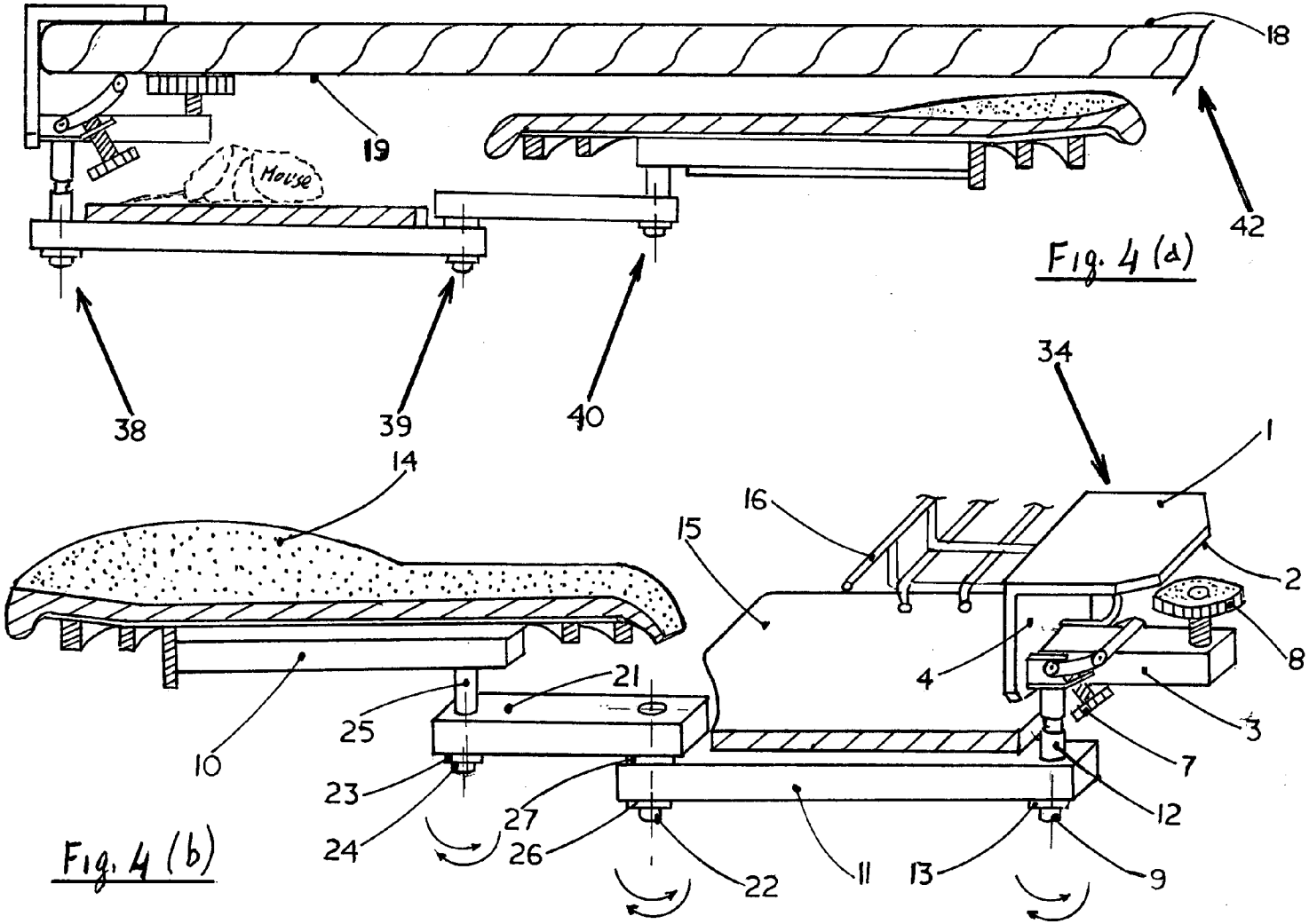
FIG. 4(*a*) is a side cross-sectional view of the arm support with pad of FIG. 1 in a fully extended stored position under the workstation desk. The figure includes the mouse (shown resting on the mouse pad), and workstation desk.

The main clamp element 35 [FIG. 2] may comprise a large barcket 1 which may be welded to small bracket 28 with protruding threaded cylinder 29 to form a partial C-shaped structure that is positioned against the top surface 18 and front edge 20 of the workstation desk 42 [FIG. 4(*a*)].

A second element of the support clamp 34, the adjustment clamp element 37 may comprise an adjustment arm 3, an adjustment bolt 8, and an alignment post 9 that connects the support clamp to the pad support arm 11. The rotating cylinder 12 may be welded to the top surface of the pad support arm 11 such that the circular hole in the rotating cylinder 12 and the circular hole in the pad support arm 11 are aligned. The upper portion of the alignment post 9 may be inserted in the vertical unthreaded circular hole in the adjustment arm 3. The lower portion of the alignment post 9 may be inserted through the circular holes in the rotating cylinder 12, the pad support arm 11. A spring clamp 13 may be used to hold the rotating cylinder 12 and pad support arm 11, and the alignment post 9 together while allowing the rotating cylinder 12 and pad support arm 11 to rotate freely around the longitudinal axis of the alignment post 9.

The pivoting arm 36 [FIG. 2] may comprise two supporting curved arms 33 rotationally attached to a U-shaped element 31, and a threaded bolt 32. The main clamp element 35 [FIG. 2] may be attached to the adjustment clamp element 37 by simultaneously aligning the horizontal circular hole in the adjustment arm 3 to the horizontal circular hole at the top end of the alignment post 9. The support clamp 34 is integral to the flexibility of operation and the structural robustness of the present invention. The design of the clamp provides stable and consistent support over all 360 degrees of rotation around the clamp swivel joint 38 created by the alignment post 9, cylinder 12, and spring clamp 13.

Assembly of the support clamp 34 [FIG. 2] may be completed by screwing the adjustment bolt 8 into the vertical threaded hole in the adjustment arm 3 such that the circular top of the adjustment bolt 8 is on the top side of the adjustment arm 3 between the adjustment arm 3 and the bottom surface 2 of the main clamp element 1.

The support clamp 34 may be attached to the workstation desk 42 [FIG. 4(*a*)] by placing the support clamp 34 on the workstation desk 42 such that the bottom surface 2 of the main clamp element 1 is adjacent to the top surface 18 of the workstation desk 42, the vertical inner surface 4 of the main clamp element 1 is adjacent to the front edge 20 of the workstation desk 42, and the top of the adjustment bolt 8 is adjacent to the bottom surface 19 of the workstation desk 42.

The support clamp 34 may be adjusted and affixed to the workstation desk by adjusting the adjustment bolt 8 to fit the thickness of the workstation desk 42 [FIG. 4(*a*)], then tightening the screw nut 7 to put pressure against the pivoting arm 36 such that the pivoting arm 36 pushes against the bottom surface 19 of the workstation desk 42, and then tightening the adjustment bolt 8 against said bottom surface 19. The downward force created by the weight of the design and the forearm of the user is distributed around three pressure points on the clamp, the main clamp element 35, the pivoting arm 36, and the adjustment fastener 8. The three points work to create an axis of rotation around their center that creates a self-locking mechanism, which increases the grasp of the clamp as more downward force is applied to Mouse-at-Ease.

The firmness of the support clamp's grasp on the workstation desk 42 is enabled by the self-locking mechanism described above, enabling the user to securely fasten the supporting clamp 34 to the workstation desk 42 without excessive tightening of the screw nut 7 and adjustment bolt 8, thus making it very easy to mount, dismount, and laterally position the design on the workstation desk 42.

Because the present invention is designed to support significant weight, large forces are exerted on the support clamp 34 at maximum load. The design of the support clamp 34 distributes this pressure over a large area of the workstation desk 42 thereby minimizing the possibility of damage to the workstation desk 42 during normal operation.

The support clamp 34, pad 15, and forearm rest 14 are interconnected by a support structure [FIG. 4(*b*)] consisting of three sturdy arms comprising the pad support arm 11, the central support arm 21, and the forearm support arm 10, which are interconnected at the pivot points by the clamp swivel joint 38, the central swivel joint 39 comprising elements 22 27 26, and the forearm swivel joint 40 comprising elements 24 25 23 respectively. The freedom of rotation provided by the support structure 41, comprised of three sturdy arms 11 21 10, and the swivel joints 38, 39, 40 allows the design to be adjusted to comfortable operating positions for the operation of the pad 15 or mouse 6, the keyboard 5, other hand-operated devices (not shown), or for the simultaneous operation of the pad 15 or mouse 6, and keyboard 5 or other hand-operated devices (not shown). The freedom of rotation also facilitates easy storage of the Mouse-at-Ease underneath the workstation desk 42 when not in use.

The vertical offsets between the the support structure 41, and the lengths of the arms have been carefully planned to provide the high operative flexibility. The forearm support arm 10 supporting the forearm rest 20 and the pad support arm 11 supporting the pad 15 are allowed full 360 degree rotation around the forearm swivel joint 40 and the clamp swivel joint 38 respectively. The central support arm 21 can rotate 180 degrees around the central swivel joint 39. The freedom of rotation of the arms allows the user to operate the design in virtually any operating position desired ensuring comfortable operation of the computer mouse, keyboard and other devices [FIG. 1,3].

The 180 degree rotation of the central arm 21 around the central swivel joint 39 determines the proximity of the forearm from the desk 42 [FIG. 1,3]. The user can easily transition to activities which require closer proximity to the workstation desk 42 (such as typing) without removing the forearm from the forearm rest 14, thereby retaining the advantages of the forearm rest 14 during these activities.

The support structure is designed such that the top of the forearm rest 14 is lower than the bottom surface 19 of the workstation desk 42 [FIG. 4(*a*)]. The lower position of the forearm rest 14 combined with the freedom of rotation of the support structure 41, allows the design to be conveniently stored under the workstation desk 42 while still attached to the workstation desk 42 when not in use. Because the design is mounted beside the user during normal operation, when it is stored under the workstation desk 42, it does not interfere with the user's knees under the workstation desk 42. This feature, combined with the low-profile design of the upper portion of the support clamp 1, makes the storage of the design completely unburdening to the user when performing other activities which do not require the design at or in proximity to the workstation desk 42.

The vertical offset between the pad support arm 11, the central support arm 21, and the forearm support arm 10 [FIG. 4(*b*)], determine the elevation of the forearm rest 14 from the pad 15. The carefully chosen offset allows the mouse 6 to be operated with the forearm resting and the wrist in line with the forearm, helping to avoid the painful problems associated with hyperextension and hyper flexion.

Computer users commonly suffer from eye strain, which is aggravated by the user's proximity to the computer monitor. Working too close to the computer monitor can not only be tiring, but with some computer monitors, it can also be unsafe. When fully extended [FIG. 4(*b*)] to the full length of the support structure 41, in one implementation, among others, the Mouse-at-Ease will stretch about twenty inches from the vertical inner surface 4 [FIG. 4(*b*)] of the main clamp element 1. This extension capability allows the user to work effectively and comfortably for long periods of time at the workstation, at a more comfortable and safer distance from the computer monitor.

Figure 5:
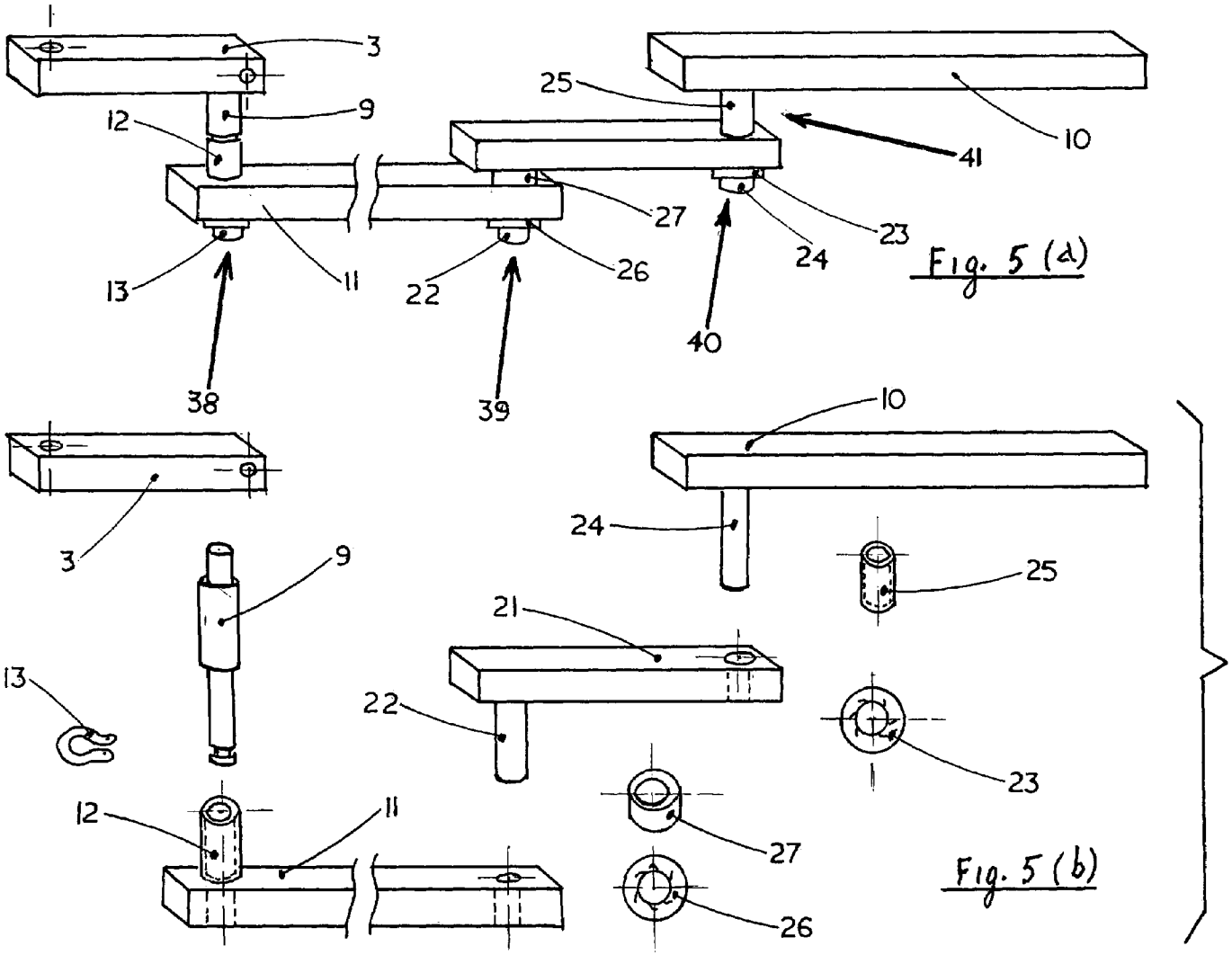
FIG. 5(*a*) is a perspective view of the support structure portion of the arm support with pad of FIG. 1. The figure includes the sturdy arm, adjustment bolt and the post that connects the support structure to the support clamp.

The forearm support arm 10 may be welded to the forearm alignment post 24. The central support arm 21 may be welded to the central alignment post 22 [FIG. 5(*b*)].

The pad support arm 11 may be attached to the support clamp 34 by attaching one end of the pad support arm 11 to the support clamp 34 as described above [FIG. 5(*a*)]. The opposite end of the pad support arm 11 may be attached to one end of the central support arm 21 [FIG. 5(*b*)] by sliding the central alignment post 22 through the cylindrical spacer 27 and through the vertical circular hole in the pad support arm 11, and pressing the clamping washer 26 to the bottom end of the central alignment post 22. The opposite end of the central support arm 21 may be attached to one end of the forearm support arm 10 [FIG. 5(*b*)] by sliding the forearm alignment post 24 through the cylindrical spacer 25 and through the vertical circular hole in the central support arm 21, and pressing the clamping washer 23 to the bottom end of the forearm alignment post 24.

The design preferably should be able to withstand significant downward force exerted at the furthest edge of the forearm rest 14, which creates maximum torque on the design when fully extended. When fully extended, the support structure 41 and support clamp 34 of the design are designed to support significant force exerted at the furthest point on the forearm rest 14 [FIG. 4(*b*)].

The support structure [FIG. 4(*b*)] is designed to provide free rotation around the swivel joints 38, 39, 40 even at the specified maximum downward force, thereby enabling effortless movement and adjustment over its full range under all specified operating conditions.

The pad 15 may be attached to the top surface of the pad support arm 11, between the support clamp 34 and the central support arm 21 [FIG. 4(*b*)]. The pad 15 may be designed of plastic or other sturdy, but flexible material.

The pad 15 was carefully selected to be large enough to accommodate a wide range of mouse placement or other devices. In combination with the forearm rest 14 and the support structure 41, the pad 15 is designed to permit the operation of the mouse with just the lateral rotation of the wrist. By adjusting the rotation angle of the pad 15, the forearm rest 14 and the central support arm 21 [FIG. 1,3], the user can choose the most comfortable position of the forearm rest 14 with respect to the pad 15, and operate the mouse effectively and comfortably over its full range of motion with effortless rotation of the wrist. The top surface of the pad 15, may be made of a textured material to enable the use of a typical computer mouse.

The forearm rest 14 may consist of a wide portion and a narrow portion. The forearm rest 14 may be fastened to the top surface of the forearm support arm 10 such that the wider portion of the forearm rest 14 is furthest from the central swivel joint 39 when the design is fully extended. The forearm rest 14 may be designed of plastic or other sturdy, but flexible material.

In contrast to other designs, which provide support for only the elbow, the shape of the forearm rest 14 has been chosen to provide a comfortable resting place for the user's entire forearm [FIG. 1,3]. By providing support for the whole forearm, the weight of the arm and shoulder are distributed over a larger area of the arm. A less ample support rest would result in greater pressure to be applied over a smaller area, causing fatigue and discomfort to develop more quickly while operating the mouse.

The wide base and resting surface of the forearm rest 14 [FIG. 9] allow the user to freely choose where to place the forearm during use. It is very important for the user to be able to choose the most comfortable position(s) [FIG. 1,3] that enable use of the mouse 6, the keyboard 5, or other hand-operated computer peripherals (not shown.) Some activities at the workstation will require the user to smoothly transition to and from the forearm rest 14. The design of the forearm rest 14, combined with the flexibility provided by the support structure 41 and swivel joints 38, 39, 40 to optimize its relative position and angle with respect to the workstation desk 42, makes it easy for the user to comfortably transition to and from the forearm rest 14 during operation of the mouse 6, keyboard 5 and other devices (not shown.) The top surface of the forearm rest [FIG. 4(*b*)] may be made of a soft or padded material to provide comfort to the user's forearm during operation.

The design may include an optional basket 16 [FIG. 1, 3, 4(*b*)], in which the mouse 6 or other hand-operated devices can be placed when not being used. The basket 16 is attached to the pad 15 by inserting the metal pins 17, that are part of the basket 16, into the corresponding holes in the pad 15. The basket 16 can be placed on either the left or right side of the pad 15, as preferred by the user.

Other preferred embodiments are also included within the scope of the present invention, as will become clear to those skilled in the art of the present invention. The above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention. For example, alternate construction materials and structures for connecting elements are contemplated. All such modifications and variations are intended to be included herein within the scope of this disclosure and the present invention.

The invention claimed is:

1. An arm support with pad, comprising:

a clamp for detachably mounting to a desk, said desk comprising a sheet of rigid material having an upper and lower surface and a front edge, a support structure comprising a plurality of arms, said plurality of arms rotationally interconnected, said support structure rotationally connected at one end to said clamp, and said support structure rotatable 360 degrees around said clamp between a using position extending from said front edge of said desk, and a storage position below said lower surface of said desk, without detaching from said clamp.

2. The arm support with pad according to claim 1, further including a pad comprising a working surface upon which a device can ride.

3. The arm support with pad according to claim 1, further including a rest comprising a sheet of rigid material of sufficient size to allow a downward force.

4. An arm support with pad, comprising:

a clamp for detachably mounting to a desk, said desk comprising a sheet of rigid material having an upper and lower surface and a front edge, a support structure comprising a plurality of arms, a pad comprising a working surface upon which a device can ride, a rest comprising a sheet of rigid material of sufficient size to allow a downward force, said plurality of arms comprising at least a first arm, a second arm and a third arm, said first arm rotationally connected at one end to said clamp with a first swivel joint and at the opposite end to said second arm with a second swivel joint, said second arm rotationally connected at one end to said first arm and at the opposite end to said third arm with a third swivel joint, said pad directly connected to said first arm, said rest directly connected to said third arm, and said support structure rotatable 360 degrees around said first swivel joint between a using position extending from said front edge of said desk, and a storage position below said lower surface of said desk, whereby enough clearance is provided between said support structure and said lower surface of said desk such that said arm support with pad can be stored, when not in use, under said desk without detaching from said clamp.

5. An arm support with mouse pad, comprising:

a clamp for detachably mounting to a desk, said desk comprising a sheet of rigid material having an upper and lower surface and a front edge, a support structure comprising a plurality of arms, a mousepad comprising a working surface upon which a computer mouse can ride, a forearm rest comprising a sheet of rigid material of sufficient size to allow the resting of a human forearm, said plurality of arms comprising at least a first arm, a second arm and a third arm, said first arm rotationally connected at one end to said clamp with a first swivel joint and at the opposite end to said second arm with a second swivel joint, said second arm rotationally connected at one end to said first arm and at the opposite end to said third arm with a third swivel joint, said mousepad directly connected to said first arm, said forearm rest directly connected to said third arm, said support structure is rotatable 360 degrees around said first swivel joint between a using position extending from said front edge of said desk, and a storage position below said lower surface of said desk, whereby enough clearance is provided between said support structure and said lower surface of said desk such that said arm support with mouse pad can be stored, when not in use, under said desk without detaching from said clamp.

6. A clamp for detachably mounting to a desk, comprising:

a generally C-shaped main clamp element comprising an large bracket consisting of an edge surface perpendicular to an upper surface, said edge surface having a near end and a far end, said near end connected to said upper surface and said far end connected to an small bracket with protruding threaded cylinder extending at an approximately 45 degree angle relative to the far end of said edge surface, a pivoting arm comprising a pivoting U-shaped element and a supporting U-shaped element, said pivoting U-shaped element including two generally parallel first and second pivoting arms interconnected at their near ends by a third pivoting arm perpendicular to said first and second pivoting arms, said first and second pivoting arms rotationally connected at their far ends to said small bracket, said third pivoting arm parallel to said upper surface and said edge surface, whereby said first and second pivoting arms may rotate from a starting position 90 degrees from said edge surface, to an ending position angle lesser than 90 degrees from said edge surface as determined by said third pivoting arm resting against said upper surface, and said supporting U-shaped element including two generally parallel first and second supporting arms interconnected at their near ends by a third supporting arm perpendicular to said first and second supporting arms and parallel to said third pivoting arm, said first and second supporting arms rotationally connected at their far ends to said first and second pivoting arms, said third supporting arm including a threaded hole through which said protruding threaded cylinder passes, whereby the turning of said protruding threaded cylinder moves said supporting U-shaped element with respect to said C-shaped main clamp element, exerting force on said pivoting U-shaped element rotating said U-shaped element between said starting position and said ending position.

* * * * *